United States Patent [19]

Ungar

[11] Patent Number: 4,642,917

[45] Date of Patent: Feb. 17, 1987

[54] ATHLETIC SHOE HAVING IMPROVED SOLE CONSTRUCTION

[75] Inventor: Marvin J. Ungar, Brookline, Mass.

[73] Assignee: Hyde Athletic Industries, Inc., Cambridge, Mass.

[21] Appl. No.: 698,405

[22] Filed: Feb. 5, 1985

[51] Int. Cl.[4] ..... A43C 15/16

[52] U.S. Cl. ..... 36/59 C

[58] Field of Search ..... 36/126, 127, 128, 129, 36/134, 59 R, 32 R, 59 C, 114; D2/320

[56] References Cited

U.S. PATENT DOCUMENTS

| | | | |
|---|---|---|---|
| D. 266,371 | 10/1982 | Stubblefield | D2/320 |
| 2,095,095 | 10/1937 | Howard | 36/127 X |
| 2,433,303 | 12/1947 | Spini | 36/59 C |
| 2,878,592 | 3/1959 | Cisko, Jr. | 36/59 X |
| 3,577,663 | 5/1971 | Mershon | 36/59 X |
| 4,194,310 | 3/1980 | Bowerman | 36/128 |
| 4,402,142 | 9/1983 | Dassler | 36/129 X |
| 4,404,759 | 9/1983 | Dassler | 36/129 |

FOREIGN PATENT DOCUMENTS

| | | | |
|---|---|---|---|
| 2618588 | 11/1977 | Fed. Rep. of Germany | 36/59 R |
| 328731 | 5/1958 | Switzerland | 36/32 R |
| 407499 | 3/1934 | United Kingdom | 36/127 |

*Primary Examiner*—Werner H. Schroeder
*Assistant Examiner*—T. Graveline
*Attorney, Agent, or Firm*—Wolf, Greenfield & Sacks

[57] ABSTRACT

A shoe having an improved sole construction in which traction devices or cleats having a substantially triangular cross-section extend downwardly from the shoe. At least some of the devices are beveled so that the lowermost side of the triangular device serves as a gripping edge that is parallel to the surface of the sole. A plurality of these beveled cleats are disposed at the perimeter of the sole, the gripping edges being parallel to the perimeter. At least some of these perimeter cleats extend outwardly beyond the perimeter of the sole and are integrally attached to both the sole and the lateral surface of the shoe so that the respective gripping edges lie parallel to, but slightly outside the shoe perimeter. The traction devices on the frontal portion of the sole within the shoe perimeter are preferably beveled cleats pointing substantially in the forward direction with their gripping edges at the back of the cleat. The cleats located within the perimeter of the heel are preferably triangular in cross-section but are not beveled, and are of less height than the beveled cleats.

6 Claims, 4 Drawing Figures

10
2
3
16
14
22
20
12
18

18
20C
20B
20A
24B
24A
12
22B
22A
22C 18
22A
20A
22
24
26A
12

20
22
24
26
24C
24A
12
20A

ATHLETIC SHOE HAVING IMPROVED SOLE CONSTRUCTION

BACKGROUND OF THE INVENTION

This invention pertains to footwear, and more particularly to an athletic shoe having an improved sole construction to provide better traction and increased comfort, and to decrease the risk of injury during athletic activities.

It is known in the prior art to provide athletic shoes such as football shoes having removable round metal cleats or integral rubber cylindrical cleats extending from the sole surface, within the perimeter of the sole. While such conventional constructions may provide reasonably satisfactory comfort and a certain amount of traction, it is believed that the level of comfort and the degree of traction could be improved. Moreover, the conventional constructions are not specifically designed to decrease the risk of injury, such as a turned ankle, that often accompanies such rugged games as football, soccer and the like.

It is thus an object of the present invention to provide a shoe having a sole construction that gives the wearer increased traction, particularly during rugged athletic activities.

It is another object of the invention to provide a shoe having a sole construction that furnishes additional comfort to the wearer as compared to conventional constructions.

It is still another object of this invention to provide a shoe having a sole construction that decreases the risk of injury to the wearer, particularly the wearer engaged in rugged athletic activities.

SUMMARY OF THE INVENTION

In accordance with the present invention, there is provided a shoe having a sole construction in which traction devices or cleats having a substantially triangular cross-section extend downwardly from the shoe. At least some of the devices are beveled so that the lowermost side of the triangular device serves as a gripping edge that is parallel to the surface of the sole. A plurality of these beveled cleats are disposed at the perimeter of the sole of the shoe, the gripping edges being parallel with the perimeter at the particular location of the cleat. At least some of these perimeter cleats extend outwardly beyond the perimeter and are attached to both the sole and the lateral surface of the shoe so that their respective gripping edges lie parallel to, but slightly outside the shoe perimeter. The traction devices on the frontal portion of the sole within the perimeter of the shoe are preferably beveled cleats pointing substantially in the forward direction with their gripping edges at the back of the cleat. The cleats located on the heel of the shoe within the perimeter are preferably triangular in cross-section but are not beveled, and are of less height than the beveled cleats.

The present invention provides the consumer with another alternative shoe construction, one that offers improved traction and increased comfort as compared to conventional constructions due to the unique shape and location of the cleats. Furthermore, the risk of injury to a wearer of a shoe made in accordance with the instant invention is greatly decreased, all as more fully explained below.

DESCRIPTION OF THE PREFERRED EMBODIMENTS

Figure 1:
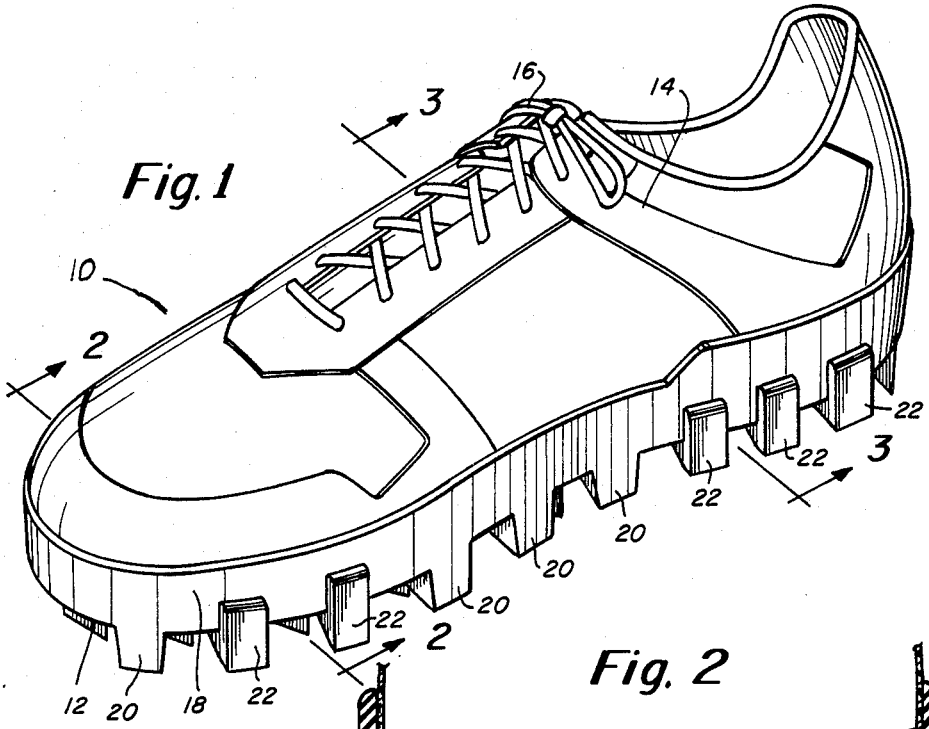
FIG. 1 is a perspective view of a preferred embodiment of a shoe having the sole construction of the present invention.

Referring to FIG. 1, there is depicted an athletic shoe 10, including an upper portion 14 of canvas, leather, or the like, and laces 16 for securing the shoe to the foot. In the preferred embodiment here depicted, sole 12 includes a lateral surface 18 that extends around the perimeter of the shoe, said surface 18 rising slightly higher around the heel portion of the shoe. Sole 12 is made of unitary molded rubber or of a suitable synthetic material.

Figure 4:
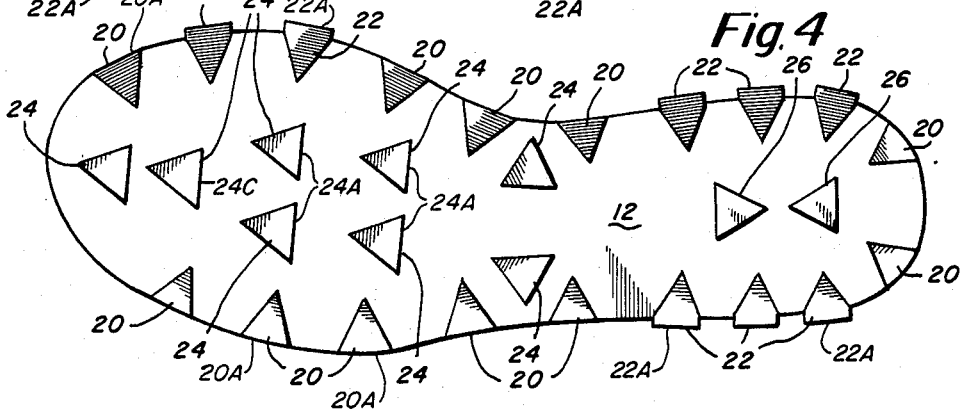
FIG. 4 is a bottom view of the sole of the shoe of FIG. 1.

Disposed on the sole 12 of the shoe are a plurality of traction devices or cleats 20, 22, 24 and 26, each being substantially triangular in cross-section. Cleats 20, 22 and 24 are beveled so that the lowermost side of the triangular cleat is parallel to the surface of sole 12 and serves as a gripping edge. Cleats 20 lie at the perimeter of the sole, their respective gripping edges 20A (see FIGS. 2 and 4) lying parallel to the shoe perimeter at their given locations. Cleats 22 extend slightly beyond the perimeter of the sole 12 and are integrally attached both to the sole 12 and to lateral surface 18, as best seen in FIG. 1. Thus the gripping edges 22A of cleats 22 lie slightly outside the shoe perimeter. In the preferred embodiment here depicted, cleats 22 are located primarily in the heel area; in the front portion of the sole, cleats 22 are disposed only on the inner side of the shoe.

Figure 3:
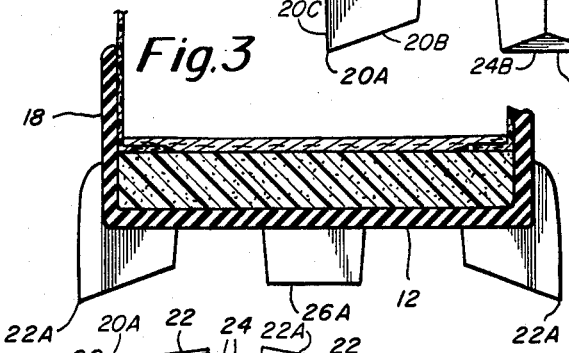
FIG. 3 is a partial cross-sectional view of the sole of the shoe of FIG. 1, taken along the line 3—3.

Cleats 24 extend from the middle and front portions of the sole within its perimeter and point toward the front of the shoe. Gripping edges 24A of the six cleats 24 located on the front portion of the sole, lie substantially orthogonal to the largest dimension of the sole. Finally, cleats 26, two in number in this preferred embodiment, are located within the perimeter of the shoe in the heel area; these cleats 26 are not beveled but rather have a bottom surface parallel to the surface of sole 12. Furthermore, as best seen in FIG. 3, cleats 26 are of less height—i.e., extend less of a distance—from the sole 12 than the remaining cleats.

Figure 2:
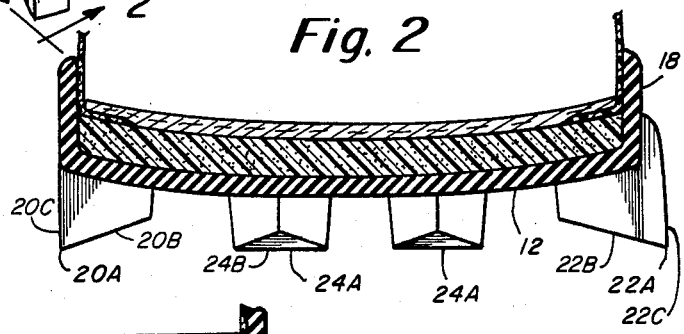
FIG. 2 is a partial cross-sectional view of the sole of the shoe of FIG. 1, taken along the line 2—2.

As best shown in FIG. 2, each of the gripping edges 20A, 22A, 24A is defined by the intersection of the respective bottom beveled surface 20B, 22B, 24B and the respective side surface 20C, 22C, 24C of the traction devices 20, 22, 24. The side surfaces 20C, 22C and 24C are generally perpendicular to the sole 12 bottom surface.

In the preferred embodiment here described, the respective gripping edges of cleats 20, 22 and 24 extend approximately one-half inch below the plane of sole 12. Cleats 26 extend about three-eights inch. Cleats 20, 22 and 24 are beveled or angled toward the sole 12 at an angle of about 25°–30° degrees with the plane of the sole.

The shoe construction of this invention is particularly useful for athletic activities conducted on grass. Cleats 20, 22, 24 and 26 are preferably formed integrally with sole 12, and are made of unitary, molded rubber or of synthetic material. The hardness of the rubber as well as the shape of the cleats serves to absorb the shock produced by rugged athletic activities, making this shoe construction safer and more comfortable. Gripping edges 20A, 22A and 24A provide excellent traction. Moreover, because the heel of the wearer's foot is effectively nestled within the cleats 22 on either side of the heel, whose gripping edges lie outside the perimeter of the heel, the heel is held in a more comfortable and safer position, and the risk of a turned ankle or other injury is greatly reduced.

It will be readily appreciated by those skilled in the art that the present invention in its broader aspects is not limited to the specific embodiments herein shown and described. Accordingly, variations may be made from the embodiments described herein which are within the scope of the accompanying claims, without departing from the principles of the invention and without sacrificing its chief advantages.

I claim:

1. A shoe having an improved sole construction comprising an upper portion, a sole, and traction device extending downwardly from said sole, said traction devices having a substantially triangular cross-section in a plane parallel to and closely adjacent said sole, at least some of the devices being beveled to form a gripping edge at the lowermost edge thereof each gripping edge being parallel to said sole and being defined by the intersection of the bottom beveled surface and one side surface of the respective traction device, said side surface being generally perpendicular to said sole.

2. The shoe of claim 1, wherein some of said beveled devices are located on either side of the heel portion of the sole and extend beyond the perimeter of the sole so that the gripping edges lie outside of but parallel to the perimeter, the devices being integrally attached to both the sole and the lateral surface of the shoe.

3. The shoe of claim 2, further comprising traction devices having a substantially triangular cross section in a plane parallel to said sole, and extending downwardly from within the perimeter of the heel portion of the sole, the lowermost surface of each of the devices being parallel to the sole, said devices extending a lesser distance from the sole than said beveled devices.

4. The shoe of claim 1, wherein some of said beveled devices are located at the perimeter of the sole, their gripping edges lying along the perireter of the sole.

5. A shoe having an improved sole construction comprising an upper portion, a sole, and traction devices extending downwardly from said sole, said traction devices having a substantially triangular cross-section in a plane parallel to and closely adjacent said sole, wherein at least some of the devices are beveled to form a gripping edge on each of said beveled devices, said gripping edge being parallel to said sole, wherein some of said beveled devices are located at the perimeter of the sole, their gripping edges lying along the perimeter of the sole, and wherein one or more of the beveled devices on the frontal portion of the sole of the shoe at the inside edge of the shoe extends beyond the perineter of the sole so that the gripping edge of each of said devices lies outside of but parallel to the perimeter of the sole, these devices being integrally attached to both the sole and the lateral portion of the shoe.

6. A shoe having an improved sole construction comprising an upper portion, a sole, and traction devices extending downwardly from said sole, said traction devices having a substantially triangular cross-section in a plane parallel to and closely adjacent said sole, wherein at least some of the devices are beveled to form a gripping edge on each of said beveled devices, said gripping edge being parallel to said sole, wherein some of said beveled devices are located at the perimeter of the sole, their gripping edges lying along the perimeter of the sole, and wherein others of said beveled devices are located within the perimeter of the sole on the front portion of the sole, the gripping edges of said devices lying substantially orthogonal to the longest dimension of the sole.

* * * * *